US007197831B2

(12) United States Patent
Nepil

(10) Patent No.: US 7,197,831 B2
(45) Date of Patent: Apr. 3, 2007

(54) CLOSURE SYSTEM FOR A FILL OPENING ON A CHALK LINE REEL HOUSING

(75) Inventor: Mark Nepil, Carpentersville, IL (US)

(73) Assignee: Keson Industries, Aurora, IL (US)

( * ) Notice: Subject to any disclaimer, the term of this patent is extended or adjusted under 35 U.S.C. 154(b) by 260 days.

(21) Appl. No.: 10/925,651

(22) Filed: Aug. 25, 2004

(65) Prior Publication Data

US 2006/0042108 A1 Mar. 2, 2006

(51) Int. Cl.
*B44D 3/38* (2006.01)
*B65D 55/16* (2006.01)

(52) U.S. Cl. ..... 33/414; 220/375

(58) Field of Classification Search ..... 33/413, 33/414, 34; 220/375, 793, 805; 215/306, 215/298, 355

See application file for complete search history.

(56) References Cited

U.S. PATENT DOCUMENTS

| | | | | | |
|---|---|---|---|---|---|
| 1,004,443 | A * | 9/1911 | Laut | 33/414 |
| 1,271,470 | A * | 7/1918 | Ibaraki | 33/414 |
| 1,907,615 | A * | 5/1933 | Towy | 215/298 |
| 2,411,349 | A * | 11/1946 | Van Alstyne | 215/298 |
| 2,630,237 | A * | 3/1953 | Rosenlof | 220/793 |
| 2,749,618 | A * | 6/1956 | Landon | 33/414 |
| 2,881,936 | A * | 4/1959 | Piker | 215/13.1 |
| 3,191,308 | A * | 6/1965 | Lindenau | 33/414 |
| 3,247,998 | A * | 4/1966 | Tantlinger | 220/834 |
| 3,306,483 | A * | 2/1967 | Bellafiore | 215/306 |
| 4,565,011 | A * | 1/1986 | Karger | 33/414 |
| 4,592,148 | A * | 6/1986 | Longenette | 33/414 |
| 5,644,852 | A * | 7/1997 | Fuller et al. | 33/414 |
| 5,709,309 | A * | 1/1998 | Gallagher et al. | 220/229 |
| 5,713,484 | A * | 2/1998 | Setty | 220/790 |
| 5,810,197 | A * | 9/1998 | Mazzarolo | 220/805 |
| 5,947,326 | A * | 9/1999 | O'Hern et al. | 220/802 |
| 6,000,566 | A * | 12/1999 | Kost | 215/48 |
| 6,237,798 | B1 * | 5/2001 | Sung | 220/375 |
| 6,332,553 | B1 * | 12/2001 | Yamada et al. | 220/375 |

* cited by examiner

*Primary Examiner*—R. Alexander Smith
(74) *Attorney, Agent, or Firm*—Wood, Phillips, Katz, Clark & Mortimer

(57) ABSTRACT

A chalk line reel having a housing and a closure assembly. The housing has a storage space for a supply of chalk and a spool around which a supply of flexible line can be wrapped. The housing further has a wall with a fill opening therethrough in communication with a storage space. The closure assembly selectively a) blocks the fill opening to confine chalk in the storage space and b) exposes the fill opening to allow introduction of chalk from a supply thereof through the fill opening into the storage space. The closure assembly has a body that is engaged with the housing wall so as to substantially fully block the fill opening with the body in an operative position, and is repositionable from the operative position into a second position wherein the fill opening is exposed. The body has a graspable tab that can be engaged by a user to facilitate repositioning of the body from the operative position into the second position.

27 Claims, 9 Drawing Sheets

CLOSURE SYSTEM FOR A FILL OPENING ON A CHALK LINE REEL HOUSING

BACKGROUND OF THE INVENTION

1. Field of the Invention

This invention relates to chalk line reels and, more particularly, to a closure system for selectively blocking a fill opening through which chalk is introduced to a storage space bounded by a housing on the chalk line reel.

2. Background Art

Chalk line reels are used extensively by professionals and hobbyists primarily for construction projects. In a typical chalk line reel, a housing defines a storage space for both a line spool and a supply of chalk. The spool is either manually rotated or spring biased for rotation in a direction to retrieve paid out line by causing the same to be wrapped around the spool.

Chalk line reels have commonly been made with a relatively small housing configuration that can be comfortably grasped by the hand of a user. This style of chalk line reel continues to be highly commercially popular and successful. However, by reason of its size, this type of chalk line reel has a limited capacity to store line and chalk.

The assignee herein offers a line of higher capacity chalk line reels, which, while functioning in substantially the same manner as those described above, accommodate a substantially greater length of line and volume of chalk.

Regardless of their configuration, the chalk line reels have a housing which accommodates a spool and defines a space for a refillable supply of chalk. Typically, the housing defining the chalk storage space has a wall with a fill opening therethrough which is in communication with the chalk storage space. Various closure systems have been devised to selectively block the fill openings. In one such closure system, a resilient plug/grommet is pressed into the fill opening so as to be frictionally held in an operative position.

The plugs/grommets are made in different forms. In one form, the plug/grommet is configured so that it must be separated from the housing to expose the fill opening. In another design, the plug/grommet has a thin wall or membrane with crossing slits therethrough so as to allow penetration by a spout on a dispensing system commonly used on containers for bulk supplies of the chalk. The spout is advanced against the thin wall/membrane and thereby bends triangular-shaped flaps inwardly to allow penetration by the spout. The flaps produce a seal around the spout and close once the spout is withdrawn so as to prevent escape of the chalk from the storage space.

Typically, this latter type of plug/grommet is designed to remain in the operative position on the housing through the chalk filling operation. The assignee herein currently offers different capacity containers with bulk chalk supplies therein, all of which utilize a discharge assembly having an elongate spout to penetrate the plug/grommet. With the larger capacity chalk line reels, refilling of the storage space with chalk using this type of discharge assembly may be a time consuming and inconvenient process. While the plugs/grommets could be wedged out of their operative position to expose the entire fill opening, the plugs/grommets are not designed to be easily or conveniently separated. Additionally, after separation, there is a risk that the plug/grommet may become lost. This is particularly a problem since the plugs/grommets are generally made from a resilient material that, once deformed to be separated, tends to spring back to an undeformed state which may cause it to be propelled away from the remainder of the chalk line reel. If this occurs, the user is required to either use a makeshift blocking structure or operate the chalk line reel with the fill opening exposed, as a result of which chalk may be allowed to escape to outside of the storage space on the chalk line reel.

SUMMARY OF THE INVENTION

In one form, the invention is directed to a chalk line reel having a housing and a closure assembly. The housing has a storage space for a supply of chalk and a spool around which a supply of flexible line can be wrapped. The housing further has a wall with a fill opening therethrough in communication with a storage space. The closure assembly selectively a) blocks the fill opening to confine chalk in the storage space and b) exposes the fill opening to allow introduction of chalk from a supply thereof through the fill opening into the storage space. The closure assembly has a body that is engaged with the housing wall so as to substantially fully block the fill opening with the body in an operative position, and is repositionable from the operative position into a second position wherein the fill opening is exposed. The body has a graspable tab that can be engaged by a user to facilitate repositioning of the body from the operative position into the second position.

In one form, the body is maintained in the operative position without the requirement of any separate fasteners.

The housing wall has a thickness between oppositely facing first and second surfaces. In one form, the body has facing third and fourth surfaces which captively engage the housing wall at the first and second surfaces to maintain the body in the operative position.

The body may be formed from a resilient material, which must be deformed from a first state to allow the body to be changed from the second position into the operative position, and springs back toward the first state as an incident of the body being changed from the second position into the operative position.

The body may be fully separated from the housing wall with the body in the second position.

In one form, the housing wall has a thickness between oppositely facing first and second surfaces, with the first surface exposed around the fill opening. The body has a third surface that abuts to the first surface with the body in the operative position. The tab has a fourth surface facing the first surface that is spaced from the first surface so as to facilitate engagement of the tab by a user.

In one form, the body has a main portion and a tab that projects in cantilever fashion from the main portion of the body.

In one form, the fill opening has a central axis and the tab has a length that projects in a direction transversely to the central axis.

The tab length may project in a direction substantially orthogonal to the central axis.

In one form, the tab is bendable from a relaxed state into a pulling state wherein the tab length projects generally parallel to the central axis.

The tab may have a contoured surface to facilitate positive grasping of the tab by a user.

In one form, the body is changeable from a position fully separated from the housing into the operative position by relatively translating the housing wall and body against each other along a line.

The closure assembly may further include a tether that is attachable to the housing.

In one form, the housing has a second opening and the tether has a post that can be press fit into the second opening to maintain a first part of the tether on the housing.

In one form, the housing wall has a thickness between first and second oppositely facing surfaces. The first part of the tether has a third surface, with the post having a fourth surface facing the third surface. With the post press fit into the second opening, the first and second surfaces are captive between the third and fourth surfaces.

The body and tether may be formed as one piece.

In one form, the body has a wall through which at least one slit is formed to allow penetration by a dispensing assembly for a supply of chalk.

The chalk line reel may be provided in combination with a supply of chalk in the storage space.

The chalk line reel may be provided in combination with a supply of flexible line wrapped around the spool.

In one form, the tab is hingedly connected to the main portion of the body.

The invention is further directed to a chalk line reel having a housing with a closure assembly. The housing defines a storage space for a supply of chalk and a spool around which a supply of flexible line can be wrapped. The housing has a wall with a fill opening therethrough in communication with the storage space. The closure assembly selectively a) blocks the fill opening to confine chalk in the storage space and b) exposes the fill opening to allow introduction of chalk from a supply thereof through the fill opening into the storage space. The closure assembly has a body that is engaged with the housing wall so as to substantially fully block the fill opening with the body in an operative position and is repositionable from the operative position into a second position wherein the fill opening is exposed. The body has a tether connected to the main portion and a first part spaced from the main portion of the body and attached to the housing.

In one form, the housing wall has a thickness between oppositely facing first and second surfaces and a second opening. The tether has a post. The first part of the tether has a third surface, with the post having a fourth surface facing the third surface. The post is press fit into the second opening so that the first and second surfaces are captive between the third and fourth surfaces.

The main portion of the body and tether may be formed as one piece, as from rubber, or other material.

In one form, a graspable tab is provided on the closure assembly which can be engaged by a user to facilitate repositioning of the body from the operative position into the second position.

The invention is further directed to a chalk line reel having a housing and a closure assembly. The housing defines a storage space for a supply of chalk and a spool around which a supply of flexible line can be wrapped. The housing has a wall with a fill opening therethrough in communication with the storage space. The closure assembly selectively a) blocks the fill opening to confine chalk in the storage space and b) exposes the fill opening to allow introduction of chalk from a supply thereof through the fill opening into the storage space. The closure assembly has a body that is engaged with the housing wall so as to substantially fully block the fill opening with the body in an operative position and is repositionable from the operative position into a second position wherein the fill opening is exposed. The closure assembly has a graspable tab that can be engaged by a user to facilitate repositioning of the body from the operative position into the second position.

In one form, the graspable tab is connected, and repositionable relative, to another part of the closure assembly.

The graspable tab may be hingedly connected to the another part of the closure assembly.

The graspable tab may be connected and repositionable relative to the another part of the closure assembly through a live hinge.

The live hinge may be defined by rubber.

In one form the graspable tab has a contoured surface that facilitates positive grasping of the tab by a user.

The graspable tab may have a flat shape.

DETAILED DESCRIPTION OF THE DRAWINGS

Figure 1:
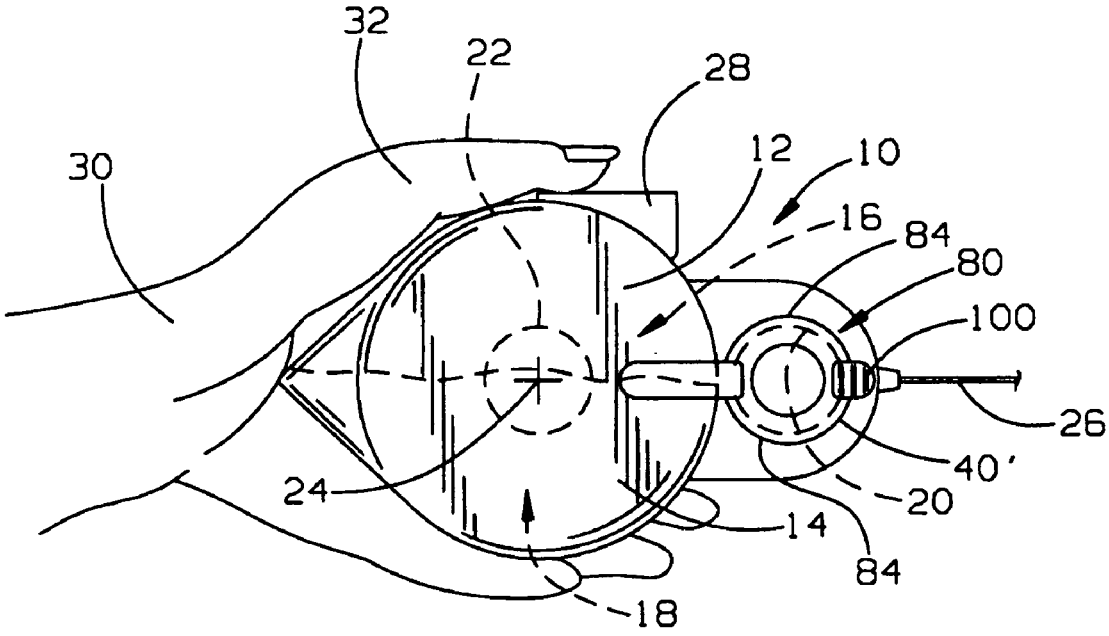
FIG. 1 is a side elevation view of one form of chalk line reel with a housing, held in the hand of a user, and defining a storage space for a spool about which line is wrapped and a supply of chalk, and with a fill opening through the housing which is blocked by a closure assembly, according to the present invention.

Referring initially to FIG. 1, one form of chalk line reel, suitable for incorporation of the present invention, is shown at 10. The chalk line reel 10 has a housing 12 with a wall 14 bounding a storage space 16 within which a supply of chalk 18 is contained. Chalk 18 is introduced to the storage space 16 through a fill opening 20 defined through the housing wall 14.

The storage space 16 also accepts a spool 22 which is rotatable around an axis 24. In the version shown, the spool 22 is normally biased in rotation around the axis 24 in a direction to retrieve a flexible line 26 by causing the line 26 to be wrapped around the spool 22. A brake mechanism (not shown) normally prevents rotation of the spool 22 and is released by operating a depressible button 28.

The housing 12 is configured so that it can be conveniently grasped in the hand 30 of a user so that the user's thumb 32 is conveniently situated adjacent to the button 28 for depression thereof. The basic unit shown in FIG. 1 has been sold by the assignee herein under the trademark SPEEDEMON®.

Figure 2:
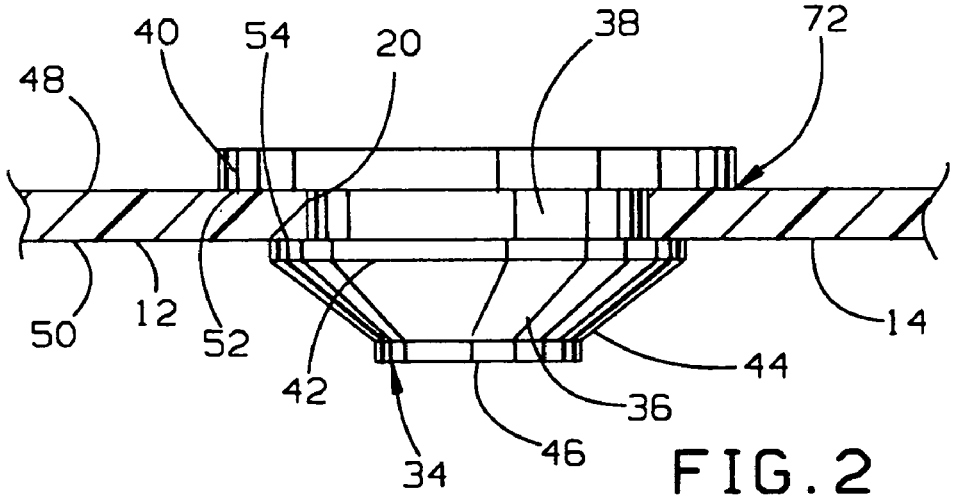
FIG. 2 (PRIOR ART)
FIG. 2 is an enlarged, fragmentary, cross-sectional view of the housing on the chalk line reel of FIG. 1 with a conventional plug/grommet in an operative position thereon to block the fill opening.
Figure 3:
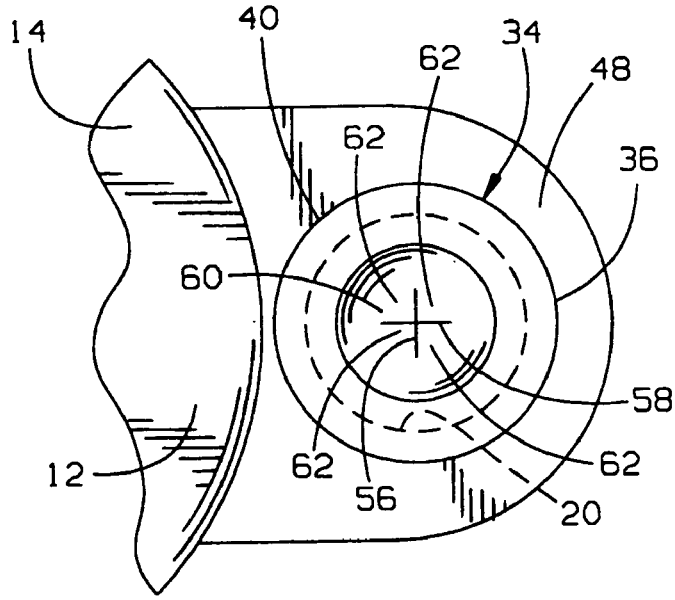
FIG.3 (PRIOR ART)
FIG. 3 is an enlarged, fragmentary, plan view of a portion of the housing with the conventional plug/grommet in the fill opening, as in FIG. 2.
Figure 4:
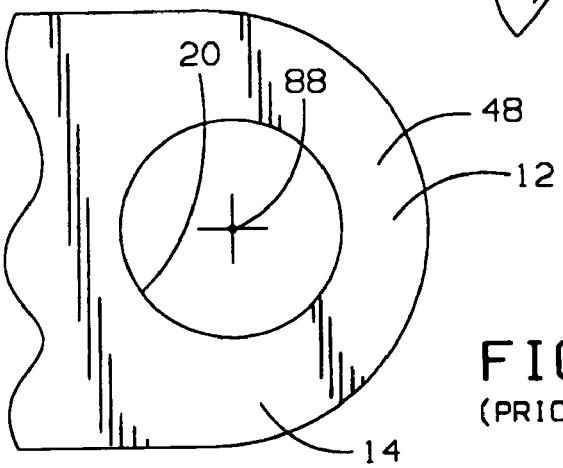
FIG.4 (PRIOR ART)
FIG. 4 is a view as in FIG. 3 with the plug/grommet removed.

Heretofore, the fill opening 20 has been blocked by a plug/grommet 34, which will be described with respect to FIGS. 2–4. The plug/grommet 34 consists of a main body 36 having a generally cylindrical shape. The body 36 has a reduced diameter midportion 38 with a diameter nominally matched to that of the fill opening 20. On axial opposite sides of the midportion 38 are enlarged, external and internal ends 40, 42, respectively. The internal end 42 has an exposed annular surface 44 which tapers from the midportion 38 towards a free end 46. The internal end 42 is compressible to allow it to be squeezed through the fill opening 20 to the operative position shown in FIGS. 2 and 3. The entire plug/grommet 34 is made from rubber to allow the required deformation. Once the operative position for the plug/grommet 34 is realized, the deformed internal end 42 springs back towards an undeformed state so that first and second oppositely facing surfaces 48, 50 on the housing wall 14 become captive between spaced, third and fourth surfaces 52, 54, respectively on the external and internal ends 40, 42 on the main body 36.

The plug/grommet 34 is configured and relatively dimensioned with respect to the fill opening 20 so that the plug/grommet 34 can be changed from a fully separated position into the operative position by a press fit step. It is intended that the plug/grommet 34 be compressibly held by the housing wall 14 with sufficient tenacity that the plug/grommet 34 is not prone to inadvertent separation during use.

Figure 5:
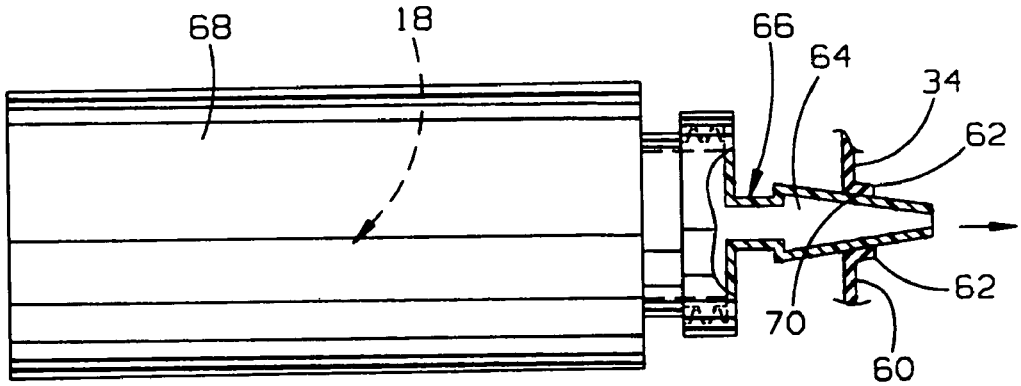
FIG.5 (PRIOR ART)
FIG. 5 is a fragmentary, cross-sectional view of the plug/grommet in FIGS. 2 and 3 with a spout on a discharging assembly directed therethrough for communication of chalk from a container into the housing.
Figure 6:
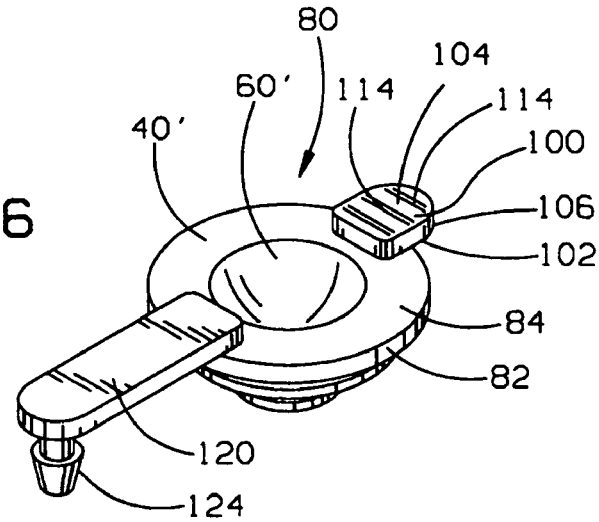
FIG. 6 is a perspective view of the inventive closure assembly in FIG. 1.
Figure 7:
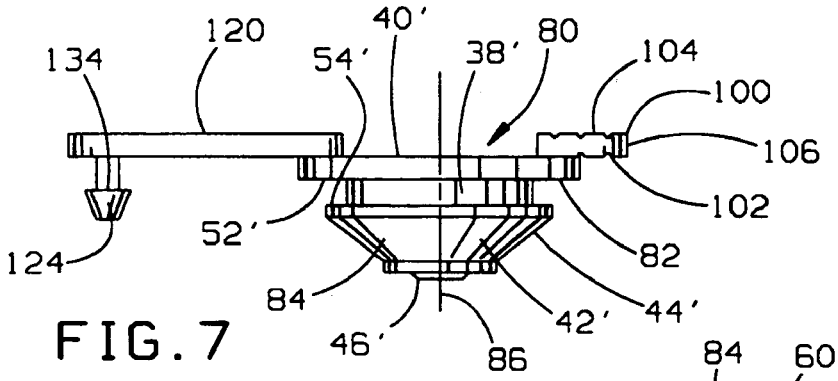
FIG. 7 is a side elevation view of the inventive closure assembly.
Figure 8:
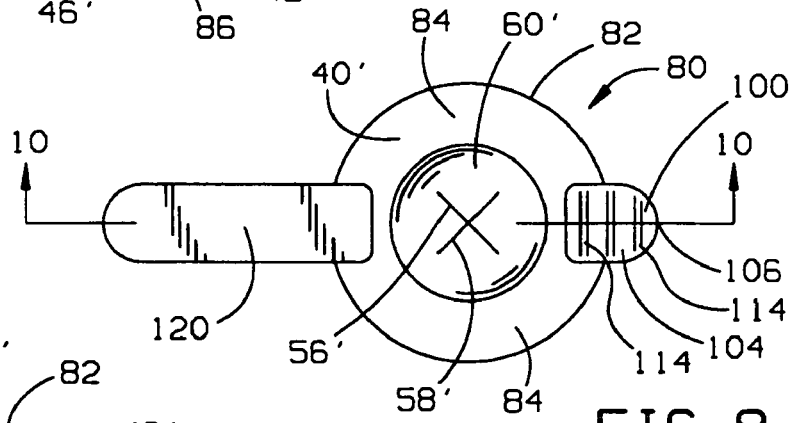
FIG. 8 is a plan view of the inventive closure assembly.
Figure 9:
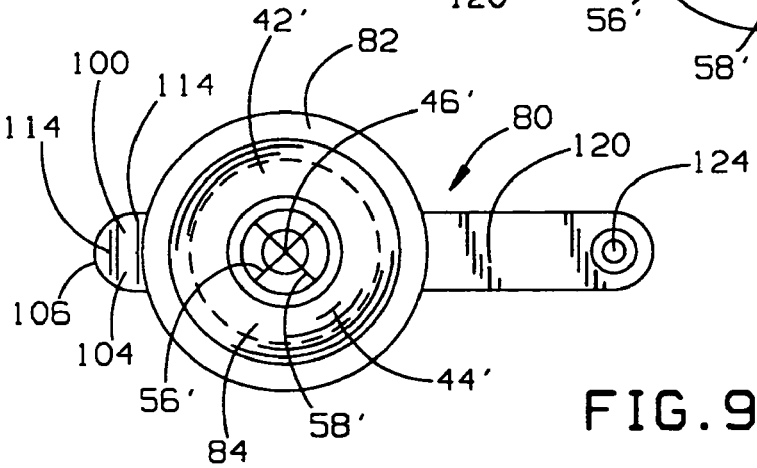
FIG. 9 is a bottom view of the inventive closure assembly.
Figure 10:
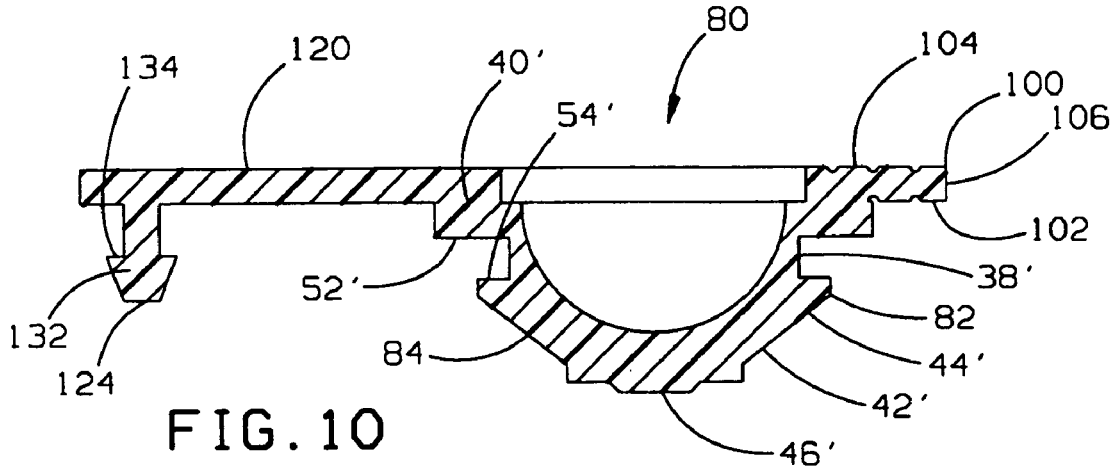
FIG. 10 is a cross-sectional view of the inventive closure assembly taken along lines 10—10 of FIG. 8.

Introduction of chalk into the storage space 16 is made possible by the provision of crossing slits 56, 58 through a wall 60 on the main body 36. These slits 56, 58 produce triangular-shaped flaps 62 which are independently bendable to define a passageway through the wall 60. More specifically, as shown in FIG. 5, this configuration of plug/grommet 34 is designed to accept a tapered spout 64 on a dispensing assembly 66 connected to a container 68 for a bulk supply of the chalk 18. By directing the spout 64 against the wall 60, the flaps 62 bend inwardly to cooperatively produce an opening 70 for the spout 64. By withdrawing the spout 64, the flaps 62 reassume their undeformed state to close the opening 70.

It is possible to separate the plug/grommet 34, once it is placed in the operative position, to thereby fully expose the fill opening 20. As shown in FIG. 2, with the plug/grommet 34 in the operative position, the surface 52 on the plug/grommet 34 flushly abuts to the exposed surface 48 on the housing wall 14. To remove the plug/grommet 34, the user must wedge the plug/grommet region at 72 away from the housing wall 14 sufficiently that it can be grasped by the user to exert a withdrawing force on the plug/grommet 34 sufficient to squeeze the internal end 42 back out through the fill opening 20. With this conventional configuration, the plug/grommet 34 does not have any readily graspable portion to facilitate withdrawal. Given that the plug/grommet 34 will be significantly compressed as it is withdrawn, upon separation, the restoring force in the material tends to cause the plug/grommet 34 to spring back aggressively to an undeformed state. This may cause the plug/grommet 34 to be propelled away from the housing 12 in such a manner that it may be lost by the user.

Figure 11:
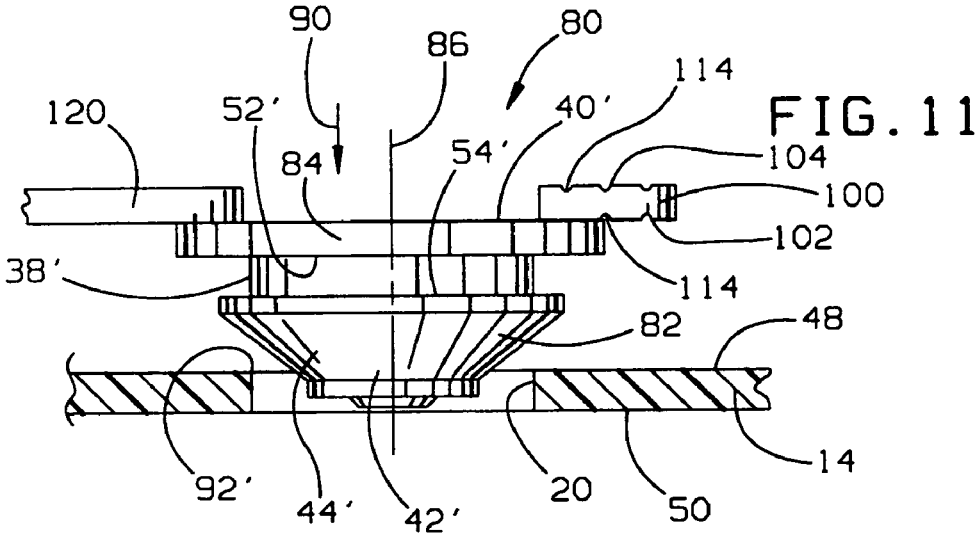
FIG. 11 is a fragmentary, cross-sectional view of a portion of the housing in FIG. 1 at the fill opening and with the inventive closure assembly being directed thereinto from an initially separated position.
Figure 12:
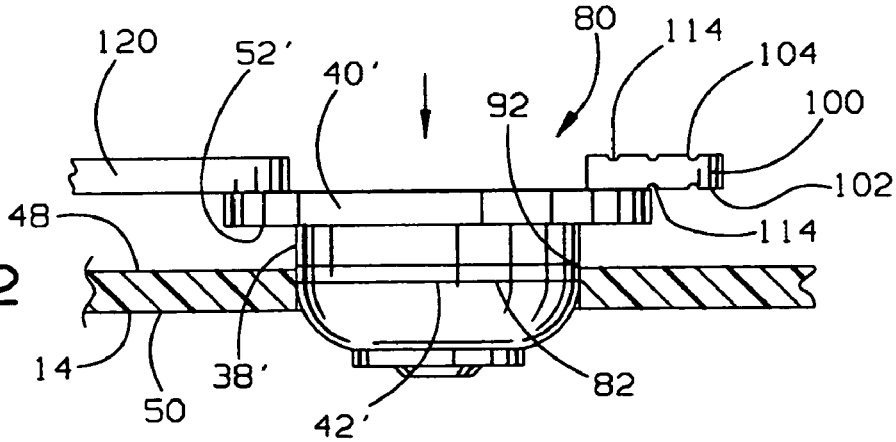
FIG. 12 is a view as in FIG. 10 with the closure assembly partially inserted into the fill opening.
Figure 13:
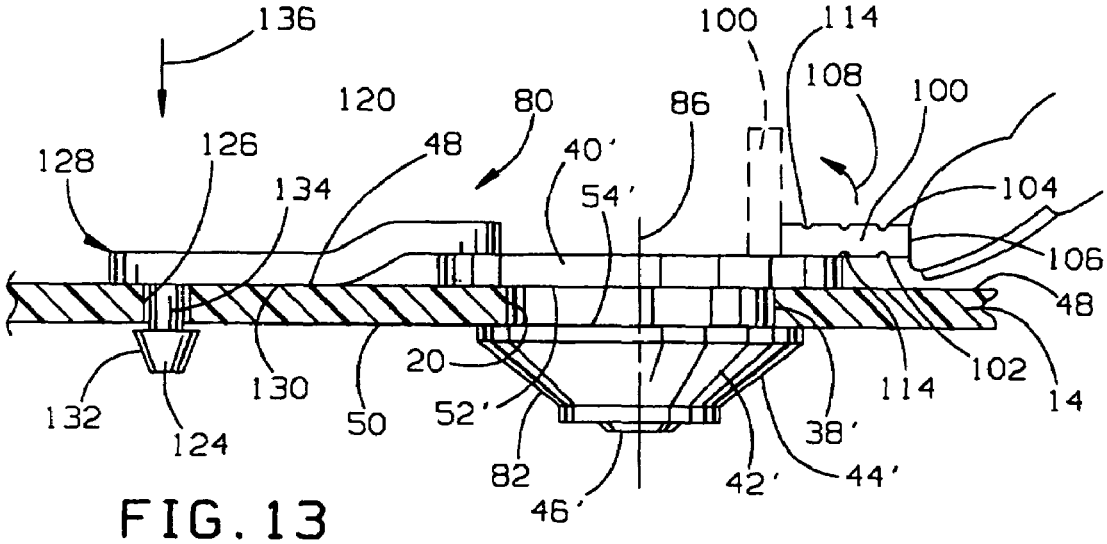
FIG. 13 is a view as in FIGS. 10 and 11 with the closure assembly in the operative position.
Figure 14:
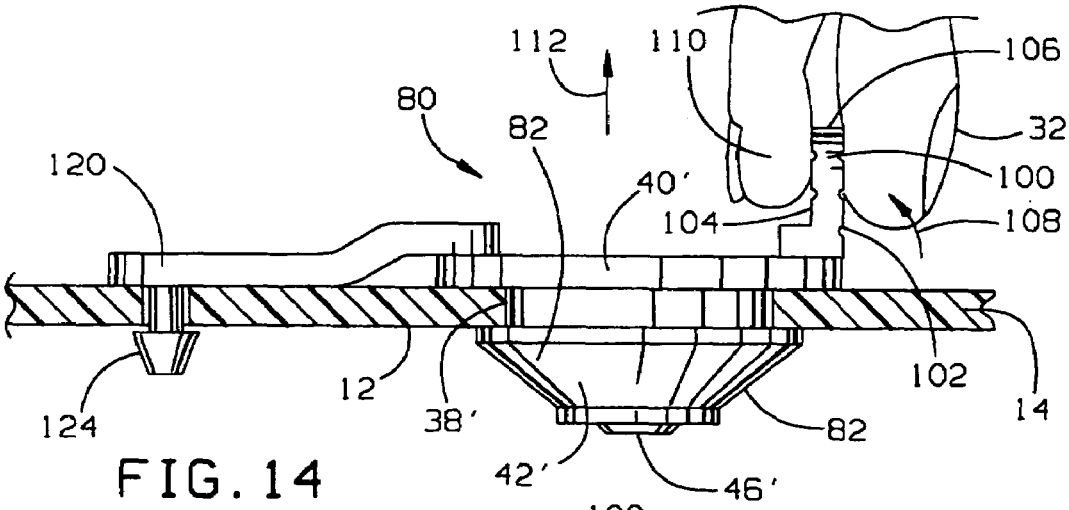
FIG. 14 is a view as in FIG. 13 wherein a tab on the closure assembly is repositioned to a pulling state.
Figure 15:
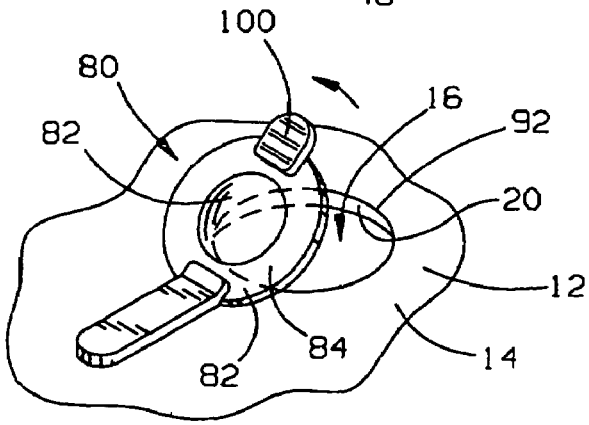
FIG. 15 is a reduced, fragmentary, perspective view of the chalk line reel housing at the fill opening with the closure assembly repositioned to expose a portion of the fill opening.

As seen in FIGS. 1 and 6–14, a closure assembly at 80, according to the present invention, is provided to selectively close a fill opening, such as the fill opening 20 described with respect to the chalk line reel 10. The closure assembly 80 has a body 82 that is engaged with the housing wall 14, with the body 82 in an operative position, as shown in FIGS. 13 and 14 so that the body 82 blocks the fill opening 20 to confine chalk 18 in the storage space 16. The body 82 is maintained in this position without requiring any separate fasteners. The body 82 is repositionable relative to the housing wall 14 from the operative position to a second position, as shown in FIG. 15, wherein the fill opening 20 is exposed to allow introduction of chalk 18 from a supply thereof into the storage space 16. In FIG. 15, the fill opening 20 is partially exposed. The body 82 can be fully separated from the housing 14 in the second position therefor so as to fully expose the fill opening 20, as shown in FIG. 11.

The body 82 has a main portion 84 that is configured similarly to the plug/grommet 34, previously described. That is, the main body portion 84 has a cylindrical shape with a reduced diameter midportion 38' between enlarged, external and internal ends 40', 42', respectively, spaced axially with respect to a central axis 86 of the main body portion 84. The internal end 42' has an exposed surface 44' which tapers from the midportion 38' towards a free end 46'. The main body portion 84 has third and fourth facing surfaces 52', 54', bounding the midportion 38', and corresponding to the third and fourth surfaces 52, 54, previously described with respect to the plug/grommet 34.

As seen in FIG. 11, with the body 82 fully separated from the housing 14, the central axis 86 of the body 82 can be aligned with the central axis 88 (FIG. 4) for the fill opening 20. By moving the body 82 axially in the direction of the arrow 90, the exposed surface 44' encounters the edge 92 around the fill opening 20 and is progressively radially compressed as axial movement of the body 82 in the direction of the arrow 90 continues. As shown in FIG. 12, eventually the internal end 42' becomes radially compressed to the diameter of the opening 20 so as to be passable therethrough. Once the internal end 42' fully clears the wall 14, the internal end 42' springs back towards an undeformed state, as shown in FIG. 13. Once this occurs, the body 82 is in the operative position such that the thickness of the wall 14 between the surfaces 48, 50 is captive between the body surfaces 52', 54'.

The body 82 has a graspable tab 100 thereon with a generally flat configuration bounded by oppositely facing flat surfaces 102, 104. The tab 100 has a length that projects in cantilever fashion from the main body portion 84. With the body 82 in the operative position, the tab surface 102 faces the housing wall surface 48 and is spaced slightly therefrom.

By reason of the configuration of the tab 100, and its situation with the body 82 in the operative position, as shown at FIGS. 13 and 14, the free end 106 of the tab is readily engageable, as by the user's thumb 32. The tab 100 is bendable in the direction of the arrow 108 in FIG. 14 from the solid line position of FIG. 13 into the phantom line position of FIG. 13 and solid line position of FIG. 14. In the relaxed state for the tab 102, shown in solid lines in FIG. 13, the length of the tab 100 is directed generally orthogonally to the axis 86 for the body 82. By pivoting the tab 100 from its relaxed state to a pulling state, as shown in phantom lines in FIG. 13 and in solid lines in FIG. 14, the tab 100 can be conveniently grasped between the user's thumb 32 and index finger 110 to allow the body 82 to be partially drawn out of the fill opening 20, as shown in FIG. 15, or fully separated therefrom by the exertion of an axial force generally in the direction of the arrow 112 in FIG. 13. In the pulling state for the tab 100, the length thereof extends generally parallel to the body axis 86 and is conveniently accessible to be positively gripped between the thumb and index fingers 32, 110 of a user, or otherwise, as by a tool, to exert a substantial drawing force on the body 82.

The flat configuration of the tab 100 also facilitates its grasping. Parallel ridges 114 are provided in both tab surfaces 102, 104 to produce a contour that also aids in the ability of the user to firmly grasp the surfaces 102, 104 and maintain a grip as a substantial pulling force is applied to the body 82 through the tab 100.

With this arrangement, the body 82 can be repositioned to partially expose the fill opening 20, as shown in FIG. 15, or fully expose the same. In either event, a relatively large area of the fill opening 20 can be exposed through which chalk 18 can be introduced into the storage space 16. The body 82 has a wall 60' with slits 56', 58', corresponding to the slits 56, 58, previously described. This allows selective filling of the storage space 16 with chalk 18 selectively through the exposed opening 20, or in conventional manner through the wall 60', as described with respect to FIG. 5.

To prevent the body 82 from being lost when it is separated from the housing 12, a tether 120 is integrally formed with and projects in cantilever fashion from, the main portion 84 of the body 82. The tether 120 is attachable to the housing 14 through a post 124. The post 124 is configured to be press fit through a second opening 126 (FIG. 13) in the housing 14.

As seen in FIG. 13, a part of the tether at 128, at which location the post 124 projects, has a surface 130 facing the housing surface 48. The post 124 has a truncated, conical head 132 with an annular surface 134 spaced from and facing the surface 130. By a press fitting step, the head 124 can be radially compressed to be squeezed through the opening 126 under a pressure applied in the direction of the arrow 136 in FIG. 13. Once the head 132 passes fully through the opening, the head 132 tends toward an undeformed state wherein the surface 134 abuts to the housing surface 50 to prevent withdrawal of the head 132. Under sufficient force, the head 132 can be deformed to be withdrawn to thereby allow separation of the closure assembly 80 fully from the housing wall 14 in the event that is desired to fully separate the closure assembly 80 from that housing 12.

Preferably, the entire closure assembly 80 is made as one piece. The closure assembly 80 may be molded from a rubber material with sufficient flexibility and compressibility to allow the installation of the body 82 and head 132 as previously described. Further, it is desirable that the tab 100 be integrally formed with the main portion 84 of the body 82 so as to produce a live hinge at which the tab 100 pivots between its relaxed and pulling states, respectively shown in solid lines and dotted lines in FIG. 13.

Figure 16:
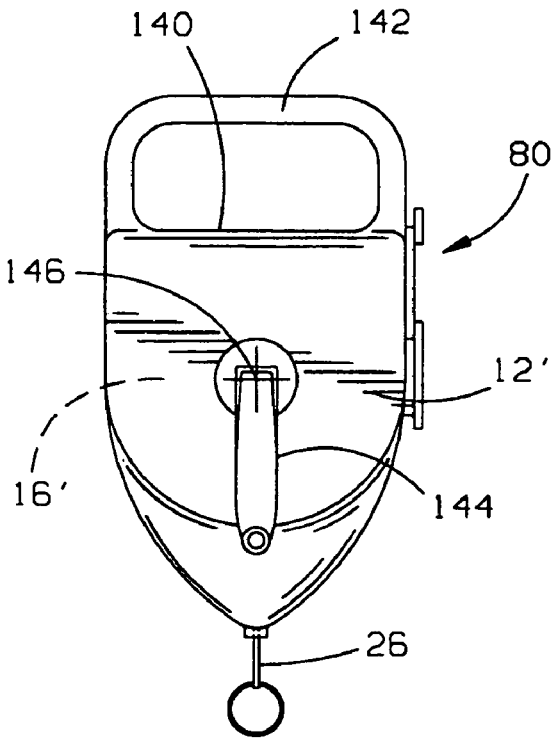
FIG. 16 is a front elevation view of a modified form of chalk line reel with the inventive closure assembly incorporated therein.
Figure 17:
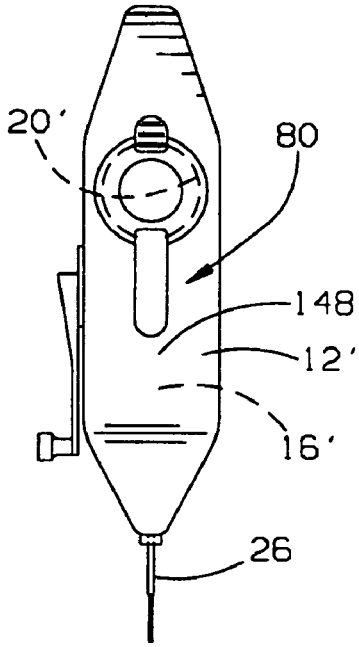
FIG. 17 is a side elevation view of the chalk line reel of FIG. 16.

The housing 12, described above, is intended only as one exemplary environment for the incorporation of the closure assembly 80. The closure assembly 80 is useable with virtually any type of housing in which a fill opening is formed. As just one example, as shown in FIGS. 16 and 17, a housing 12' is shown of the type commercially offered by the assignee herein under the trademark "GIANT". The housing 12' defines a significantly larger storage space 16' and has an opening 140 formed therethrough to define a graspable portion 142 that can be surrounded by the hand of a user. A handle 144 is manually rotatable to pivot an internal spool (not shown) around an axis 146 to direct the flexible line 26 onto the spool. In this embodiment, the housing has a side wall portion 148 through which the fill opening 20' is formed.

Figure 18:
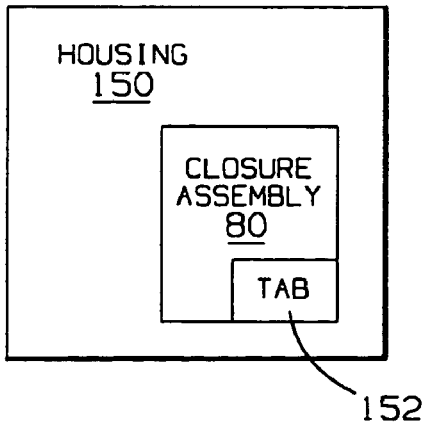
FIG. 18 is a schematic representation of a chalk line reel according to the present invention.

As shown more generically in FIG. 18, the invention contemplates incorporation of the closure assembly 80 into virtually any type of chalk line reel having a housing 150. The closure assembly 80, with the tab 152 thereon, is intended to be operatively associated with any type of fill opening, regardless of its location on the housing.

Figure 19:
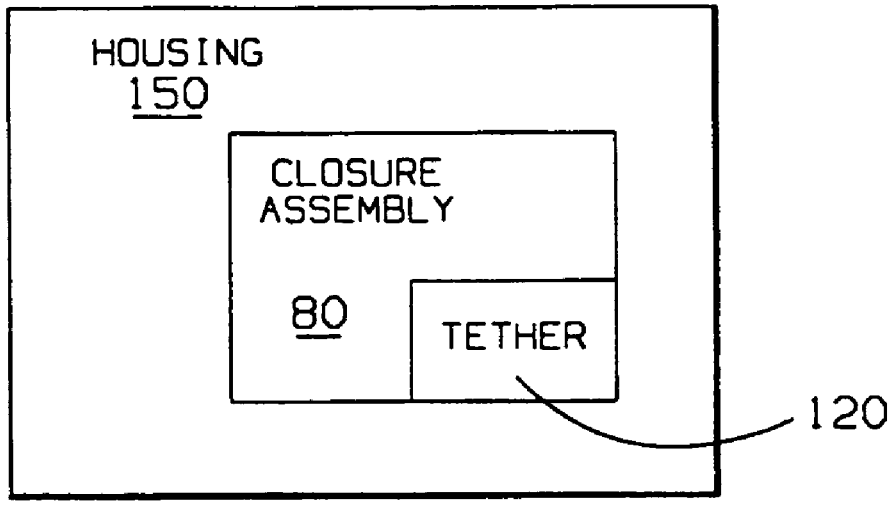
FIG. 19 is a view as in FIG. 18 of a modified form of chalk line reel, according to the present invention.

As shown in FIG. 19, the invention also contemplates a closure assembly 80 having the tether 120 utilized on the housing 150, with or without the tab 152.

Figure 20:
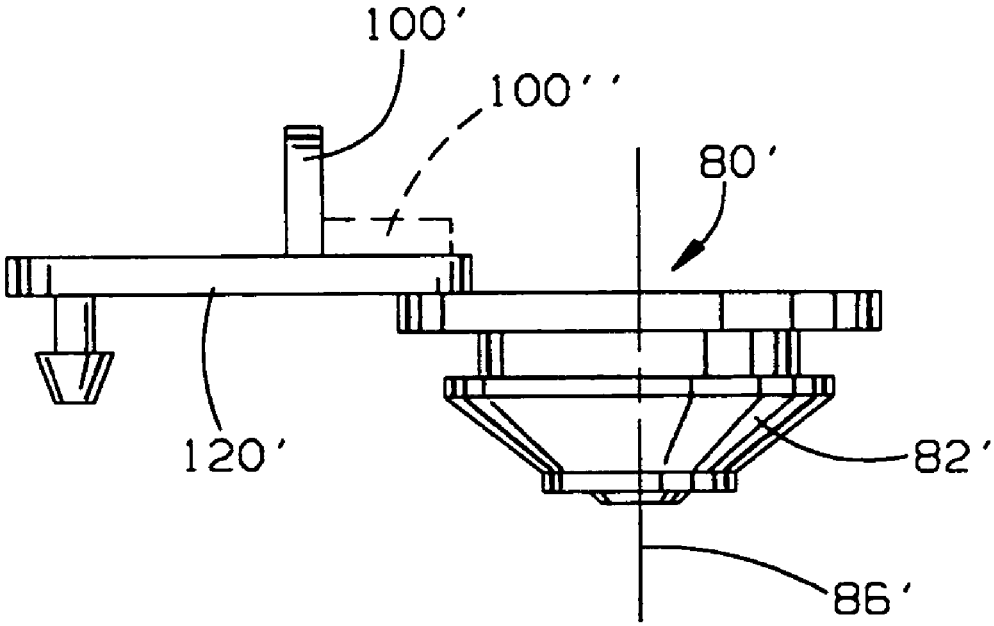
FIG. 20 is a view as in FIG. 7 of a modified form of closure assembly.

A further modification, according to the present invention, is shown on a closure assembly 80' in FIG. 20. The closure assembly 80' has the same configuration as the closure assembly 80, with the exception that a tab 100' is located on a corresponding tether 120'. The tab 100' can be placed elsewhere on the closure assembly 80' to perform as described above.

As shown in FIG. 20, the tab 100' projects generally parallel to the central axis 86' of the body 82'. Alternatively, as shown at 100", the tab could be placed at another location and be bendable between relaxed and pulling states, as previously described.

Figure 21:
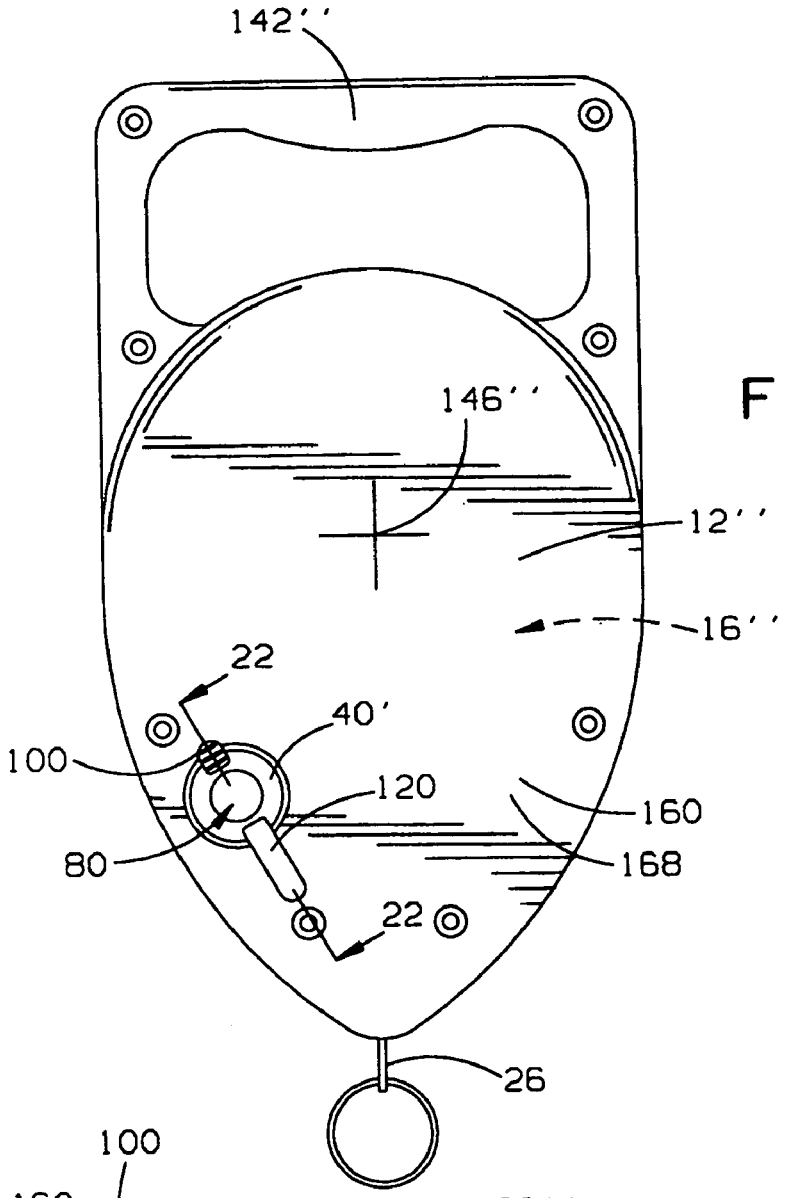
FIG. 21 is a rear elevation view of a modified form of chalk reel with a housing having a recess to accommodate the inventive closure assembly; and with the inventive closure assembly in an operative position.
Figure 22:
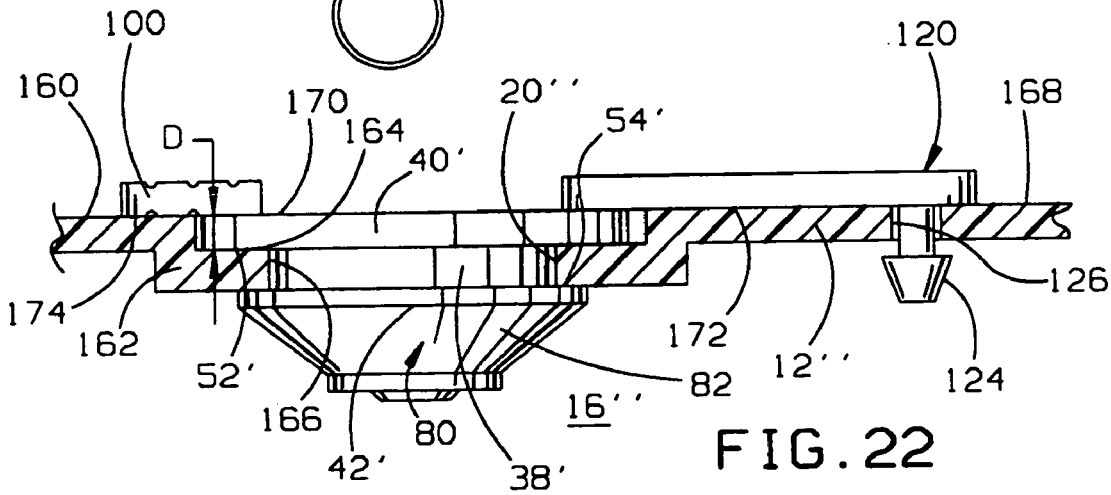
FIG. 22 is an enlarged, fragmentary, cross-sectional view of the housing and closure assembly taken along line 22—22 of FIG. 21.

A modified form of housing, according to the invention, is shown at 12" in FIGS. 21 and 22. The housing 12" has the same general construction as the housing 12', to include a graspable portion 142", that can be surrounded by the hand of a user, and a spool (not shown) which is movable around an axis 146" to selectively pay out and retrieve a supply of flexible line 26.

The housing 12" has a substantially flat rear wall 160 which bounds a line and chalk storage space 16". The wall 160 has a recessed portion 162 defining a surface 164 that is at least nominally matched in shape to the external end 40' of the closure assembly 80. A fill opening 20" is formed through the wall portion 162 to allow passage therethrough of the internal end 42' of the closure assembly 80 in the same manner that the internal end 42' of the closure assembly 80 is allowed to pass through the opening 20 on the housing 12, as previously described. In the operative position for the closure assembly 80, an edge 166, bounding the opening 20", surrounds the mid-portion 38' of the closure assembly 80 so that the wall portion 162 becomes captive between the surfaces 52', 54' on the closure assembly 80.

The surface 164 is recessed from the housing outer surface 168 to a depth D, equal approximately to the thickness of the external end 40' of the closure assembly 80, so that the exposed surface 170 of the closure assembly 80, on the external end thereof, is substantially flush with the outer housing surface 168. Thus, with the closure assembly 80 in the operative portion of FIGS. 21 and 22, the inside surface 172 of the tether 120 and inside surfaces 174 of the graspable tab 100 facially abut to the housing outer surface 168 with the tether 120 and graspable tab 100 in a relaxed state.

The housing 12" has an opening 126" to accept the post 124 so that the tether 120 will releasably maintain the closure assembly 80 attached to the housing 12" with the body 82 withdrawn from the opening 20" to facilitate refilling of the storage space 16".

By reason of mounting the closure assembly 80 in a recessed position, the closure assembly 80 has a lower exposed profile, making it less likely that the closure assembly 80 will become snagged on an object in a manner that the closure assembly might become inadvertently separated from the housing 12" in use. This allows the closure assembly 80 to be more strategically located on the housing 12". That is, as shown in FIG. 21, the closure assembly 80 is situated so that with the body 82 withdrawn from the fill opening 20", the user can look through the fill opening 20" and conveniently ascertain the nature and quantity of both chalk and flexible line in the storage space 16". In the absence of the recessed construction, the protruding closure assembly 80 would be prone to being snagged and pulled away from the housing wall 160, upon which the housing 12" is commonly supported when not in use.

Figure 23:
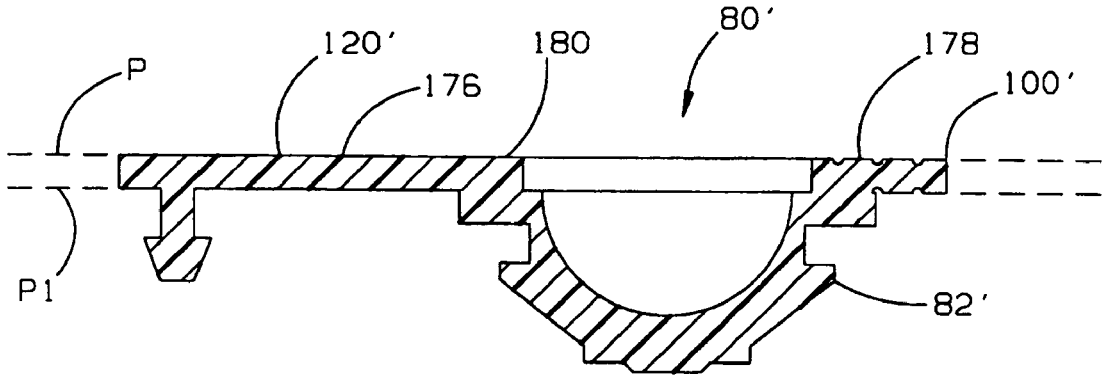
FIG. 23 is a view as in FIG. 10 of a modified form of closure assembly, according to the invention.

The invention contemplates variations to the structure described above. As just one example, as shown in FIG. 23, the closure assembly 80' may be modified so that one, or both, of the graspable tab 100' and tether 120' reside within a space bounded by two parallel reference planes P, P1, with the external surfaces 176, 178 on the tether 120' and tab 100' being coplanar with each other and the reference plane P, as well as with the outer surface 180 on the main body 82'.

The foregoing disclosure of specific embodiments is intended to be illustrative of the broad concepts comprehended by the invention.

The invention claimed is:

1. A chalk line reel comprising:

a housing defining a storage space for a supply of chalk and a spool around which a supply of flexible line can be wrapped, the housing comprising a wall with a flat surface portion with a substantial area and having a fill opening therethrough in communication with the storage space; and a closure assembly for selectively a) blocking the fill opening to confine chalk in the storage space and b) exposing the fill opening to allow introduction of chalk from a supply thereof through the fill opening into the storage space, the closure assembly comprising a body that is pressed into the fill opening in the housing wall so as to substantially fully block the fill opening with the body in an operative position and repositionable from the operative position into a second position wherein the fill opening is exposed, the body having a graspable tab that can be engaged by a user to facilitate repositioning of the body from the operative position into the second position, wherein the graspable tab projects in cantilever fashion from the main portion of the body and has a length, wherein the tab is bendable from a relaxed state into a pulling state wherein the tab can be grasped and pulled to change the body from the operative position into the second position, wherein with the tab in the relaxed state, the tab length overlies and extends generally parallel to the flat surface portion over a substantial portion of the length of the tab.

2. The chalk line reel according to claim 1 wherein the body is maintained in the operative position without the requirement of any separate fastener.

3. The chalk line reel according to claim 1 wherein the housing wall has a thickness between oppositely facing first and second surfaces and the body has facing third and fourth surfaces which captively engage the housing wall at the first and second surfaces to maintain the body in the operative position.

4. The chalk line reel according to claim 3 wherein the body comprises a resilient material that must be deformed from a first state to allow the body to be changed from the second position into the operative position and springs back toward the first state as an incident of the body being changed from the second position into the operative position.

5. The chalk line reel according to claim 4 wherein the body is fully separated from the housing wall with the body in the second position.

6. The chalk line reel according to claim 1 wherein the housing wall has a thickness between oppositely facing first and second surfaces, the first surface is exposed around the fill opening, the body has a third surface that abuts to the first surface with the body in the operative position and the tab has a fourth surface facing the first surface and spaced from the first surface so as to facilitate engagement of the tab by a user.

7. The chalk line reel according to claim 1 wherein has a width that is substantially less than the length of the tab.

8. The chalk line reel according to claim 1 wherein the fill opening has a central axis and the tab has a length that projects in a direction transversely to the central axis and the tab abuts to the flat surface portion over a substantial portion of the length of the tab.

9. The chalk line reel according to claim 8 wherein the tab length projects in a direction substantially orthogonal to the central axis.

10. The chalk line reel according to claim 8 wherein the housing wall has a thickness between oppositely facing first and second surfaces, the first surface is exposed around the fill opening, the body has a third surface that abuts to the first surface with the body in the operative position and the tab has a fourth surface facing the first surface and spaced from the first surface so as to facilitate engagement of the tab by a user.

11. The chalk line reel according to claim 10 wherein the tab has a contoured surface to facilitate positive grasping of the tab by a user.

12. The chalk line reel according to claim 11 wherein the body is changeable from a position fully separated from the housing into the operative position by relatively translating the housing wall and body against each other along a line.

13. The chalk line reel according to claim 1 wherein the tab is bendable from a relaxed state into a pulling state wherein the tab length projects generally parallel to the central axis, the tab bendable between the relaxed and pulling states through approximately 90°.

14. The chalk line reel according to claim 1 wherein the closure assembly further comprises a tether that is attachable to the housing.

15. The chalk line reel according to claim 14 wherein the housing has a second opening and the tether has a post which can be press fit into the second opening to maintain a first part of the tether on the housing.

16. The chalk line reel according to claim 15 wherein the housing wall has a thickness between first and second oppositely facing surfaces, the first part of the tether has a third surface, the post has a fourth surface facing the third surface, and with the post press fit into the second opening, the first and second surfaces are captive between the third and fourth surfaces.

17. The chalk line reel according to claim 16 wherein the body and tether are formed as one piece.

18. The chalk line reel according to claim 14 wherein the tether and tab project in diametrically opposite directions from the main portion of the body.

19. The chalk line reel according to claim 1 wherein the body has a wall through which at least one slit is formed to allow penetration of a dispensing assembly for a supply of chalk.

20. The chalk line reel according to claim 1 in combination with a supply of chalk in the storage space.

21. The chalk line reel according to claim 20 in combination with a supply of flexible line wrapped around the spool.

22. The chalk line reel according to claim 1 wherein the tab is hingedly connected to the main portion of the body.

23. The chalk line reel according to claim 1 wherein the graspable tab is connected and repositionable relative to the main portion of the body through a live hinge.

24. The chalk line reel according to claim 23 wherein the live hinge is defined by rubber.

25. The chalk line reel according to claim 23 wherein the graspable tab has a contoured surface that facilitates positive grasping of the graspable tab by a user.

26. The chalk line reel according to claim 25 wherein the graspable tab has a flat shape.

27. The chalk line reel according to claim 1 wherein the main portion of the body is press fit into the fill opening along a first line, with the tab in the relaxed state, the length of the tab is traverse to the first line, and with the tab in the pulling state, the length of the tab is generally parallel to the first line.

* * * * *